US006601973B2

(12) United States Patent
Rasmussen et al.

(10) Patent No.: US 6,601,973 B2
(45) Date of Patent: Aug. 5, 2003

(54) LIGHT EFFECTS SYSTEM

(75) Inventors: Niels Jorgen Rasmussen, Arhus C (DK); Mads Glavind, Hobro (DK)

(73) Assignee: Martin Professional A/S (DK)

( * ) Notice: Subject to any disclaimer, the term of this patent is extended or adjusted under 35 U.S.C. 154(b) by 0 days.

(21) Appl. No.: 09/892,083

(22) Filed: Jun. 26, 2001

(65) Prior Publication Data

US 2002/0075685 A1 Jun. 20, 2002

(30) Foreign Application Priority Data

Jun. 26, 2000 (DK) ..... 2000 00995

(51) Int. Cl.[7] ..... F21V 9/00; F21V 29/00

(52) U.S. Cl. ..... 362/282; 362/293; 362/322; 362/373

(58) Field of Search ..... 362/284, 293, 362/324, 319, 340, 322, 282, 373, 552, 583, 300, 326, 811; 353/97; 359/813, 814, 889

(56) References Cited

U.S. PATENT DOCUMENTS 4,392,187 A 7/1983 Bornhorst ..... 362/233
4,460,943 A 7/1984 Callahan ..... 362/276
4,827,387 A * 5/1989 Ferren et al. ..... 362/284
4,891,738 A 1/1990 Richardson ..... 362/282
4,984,143 A * 1/1991 Richardson ..... 362/293
5,402,326 A 3/1995 Belliveau ..... 362/284
5,779,353 A * 7/1998 Kacheria ..... 362/293
5,823,661 A * 10/1998 Mahanay et al. ..... 362/293
6,152,577 A * 11/2000 Rizkin et al. ..... 362/293
6,224,248 B1 * 5/2001 Chiba ..... 362/580

* cited by examiner

*Primary Examiner*—Y. My Quach-Lee
*Assistant Examiner*—Peggy A. Neils
(74) *Attorney, Agent, or Firm*—Skadden, Arps, Slate, Meagher & Flom LLP

(57) ABSTRACT

A light effects projector includes a light source and effect wheels interposed between the light source and an exit aperture of the projector. A gobo wheel includes a plurality of apertures and gobo holders containing gobos. The gobo wheel is adapted to rotate so as to place a gobo, which is retained in one of the holders, within the light path from the light source. The gobo holders of the gobo wheel are removably secured to the gobo wheel by a spring retainer that engages flange portions of a gobo holder. The projector further includes a cooling system to cool the gobos during operation. Additionally, the projector includes an effects wheel that provides a "frost effect" portion to variably distort light from the projector.

14 Claims, 9 Drawing Sheets

LIGHT EFFECTS SYSTEM

CROSS-REFERENCE TO RELATED APPLICATIONS

This application claims the benefit, under 35 U.S.C. §119, of Danish Patent Application No. PA2000 00095, entitled "Effects modules and combinations thereof to produce a variety of lighting effects," filed Jun. 26, 2000.

FIELD OF THE INVENTION

The present invention relates to automated lighting systems for use in entertainment, promotional, and architectural applications. Particularly, the invention relates to manipulating a light beam from such projectors to produce lighting effects.

BACKGROUND

Conventional projectors for stage, theater, architectural, and display illumination include means for removably inserting various types of optical beam modifiers into the path of a light beam to vary the color, intensity, size, shape, and pattern of the beam. Thus, in a typical system, a light source produces white light which is passed, for example, through at least one color filter wheel for producing a colored light beam, a gobo wheel for imposing a selected pattern on the light beam, a light intensity wheel for varying the intensity of the light transmitted therethrough, a mechanical iris for determining beam size, and a lens system for controlling light beam focus and divergence. U.S. Pat. No. 4,392,187 to Bornhorst discloses several such systems.

For imposing a desired pattern on the light beam, it is well known to pass the beam through a gobo, which is a template or light stencil having a predetermined pattern. Typically, gobos are formed by chemically etching the desired pattern onto stainless steel discs. The gobos discs are usually supported in the projected light beam to impose upon the light passing therethrough the pattern which has been etched into the discs. It is well known, for example from U.S. Pat. No. 4,460,943 to Callahan, to provide a mounting plate having a plurality of equally spaced apertures arranged around a common axis for mounting gobos within one or more of the apertures. The plate is drivingly rotatable, such as via a motor, about its axis to insert a selected gobo into the path of the beam of light. U.S. Pat. No. 4,891,738 to Richardson discloses a similar arrangement including an apertured gobo mounting plate which is rotatably driven by motor driven rollers frictionally engaging the peripheral edge of the plate. The gobos are mounted on or within holders which, in turn, are fixedly positioned within the plate apertures. The mounting plate is rotatably driven to position a selected gobo within the beam of light. After reaching this position, a motor-operated holder drive mechanism acts, through frictional contact with the rim of the holder, to rotatably drive the gobo holder in either direction at various speeds. In this manner, the plate is rotatable to position a selected gobo within the beam of light and the gobo holder is rotatable to spin the gobo holder within the beam of light.

Generally, the projectors are constructed in a compact fashion because the rotational inertia of the projector increases the speed at which the beam of light can be moved into position. This compact design leads to various disadvantages in the maintenance and upkeep of the projectors. Furthermore, the compact design of the projectors hinders the replacement of gobos in the projector.

For example, U.S. Pat. No. 5,402,326 to Belliveau discloses a gobo carousel that contains a number of gobo holders. The carousel is rotatable to position a desired gobo within the light path and further includes means for rotating the holders relative to the carousel itself. The holders are permanently attached to the carousel and include a mechanism for securely retaining and for replacing gobos from within the holders. However, due to the compact design of the light projector, such gobo carousels, as well as the gobo holders, are often mounted in close proximity to adjacent mechanical parts. Accordingly, replacing the gobos in the gobo holders can be very awkward. Therefore, there is a need for a system that enables easy exchange of the gobos in such compactly constructed projector.

Another problem related to the compact design of the projector is thermal management. In high intensity versions of such projectors, the interception of the light beam by gobos leads to a build up of heat. If this heat is not sufficiently managed, deterioration and even destruction of the gobos can result. In order to keep the gobo within necessary operating temperature ranges while intercepting the light beam, an appropriate thermal management system should be employed. Therefore, there is a need for a compact system for facilitating the thermal management of the gobos. Additionally, when projecting light onto a subject, it is often desirous to blur the image, which is known as a "frost effect." The frost effect is typically provided by a pair of opposed flags that partially intercept the beam, the extent thereof providing a variable degree of frost. However, such frost effect systems are difficult to maintain and configure in compact projectors. Therefore, there is a need for a convenient and easily configured system for providing image frost effects.

SUMMARY OF THE INVENTION

The present invention provides a system and method for easily replacing gobos in a compact projector by providing rotatable gobo holders that are adapted to be easily removed from and reattached to the permanently mounted gobo carousel. In accordance with one aspect of the invention, a gobo wheel assembly is provided including a rotatable base plate, a gobo holder, a spring retainer adapted to removably couple the gobo holder, and a central sun gear.

There is further provided a gobo cooling system including an air flow and a window positioned within the light path in the projector. The window is positioned within the air flow to deflect air to a gobo.

Additionally, there is provided an effects wheel including a rotatable baseplate and a transparent frost filter forming a portion of the baseplate for creating frost effects.

DETAILED DESCRIPTION

As general background, a description of an exemplary projector of the art is provided below. However, as may be appreciated, projectors in accordance with the invention include various other components and configurations. A projector of the prior art usually includes a light beam that emanates from a light source at a first end of the projector. The beam passes through a series of lenses and color filters before reaching the projector's gobo wheel. The gobo wheel is generally a single, drivingly rotatable wheel having multiple patterns etched therein and distributed about its outer periphery. In some projectors, a motor operated iris increases or decreases beam size before the beam encounters a motor operated effects wheel, which includes appropriate inserts mounted in peripherally distributed window apertures for creating desired modifying effects on the beam, such as altering beam pattern, color or diffusion, creating a prismatic effect, and the like. Finally, the projector may pass the light beam through one or more lenses for providing a zoom effect and for adjusting beam focus and/or divergence prior to exiting the projector housing.

Figure 1A:
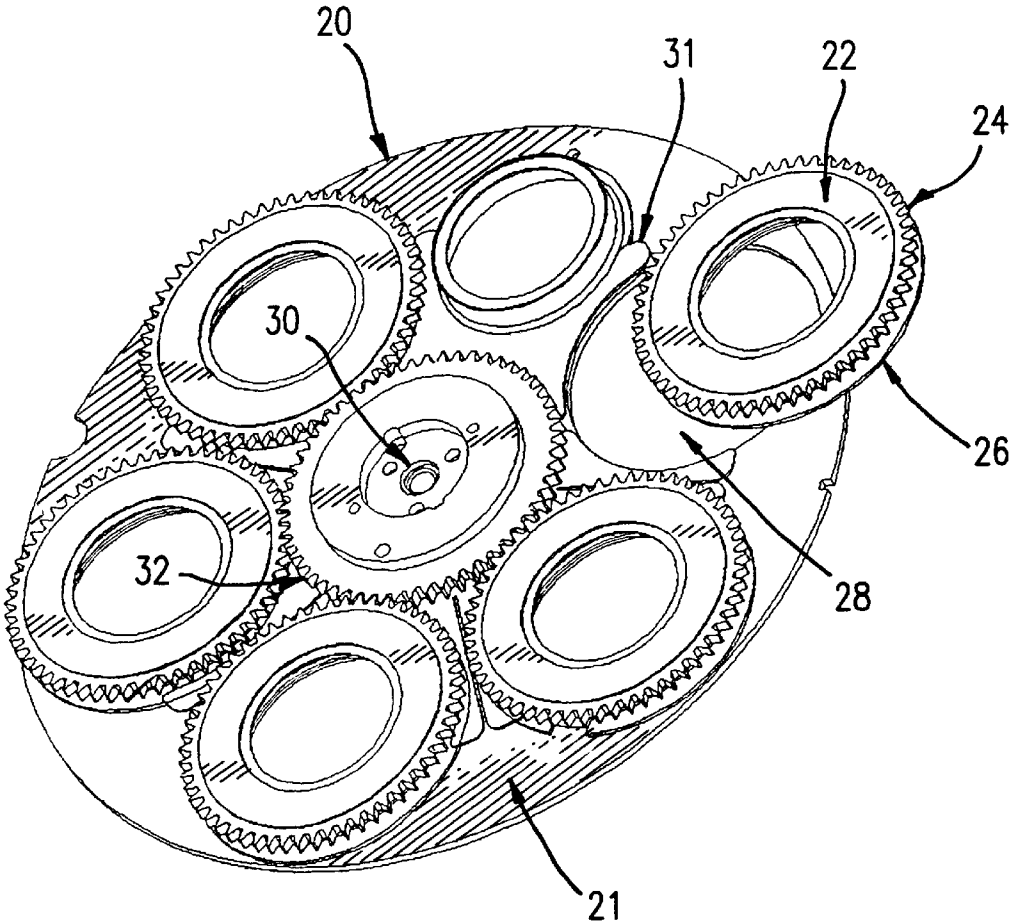
FIG. 1A is a front perspective view of a gobo wheel in accordance with the invention.

FIG. 1A illustrates a rotatable gobo wheel assembly 20 in accordance with the invention. The gobo wheel assembly 20 includes a circular gobo baseplate 21 for supporting a plurality of gobo holders 22. In the illustrated embodiment, the baseplate 21 includes six apertures 28 extending therethrough and positioned around, and equally spaced from, a central axis of the baseplate 21 for receiving respective gobo holders 22. The baseplate 21 also includes a central hub 30 extending outwardly from one surface of the baseplate for attachment to a rotatable shaft of a motor (not shown) for rotating the baseplate to position one of the gobo holders 22 in the light path.

A spring retainer 31 is attached to the baseplate. A central sun gear 32 is coupled to a gear motor by a rotatable shaft (not shown). In this manner, the gear motor rotates with the entire gobo baseplate 21 while the sun gear 32 is able to rotate independent of the rotation of baseplate. In a typical fashion, sun gear 32 teeth formed on the peripheral edge of the sun gear engage complimentary to other portions 24 formed on the outer periphery of each gobo holder 22 for rotating the gobo holders upon rotation of the sun gear.

The spring retainer 31 is adapted to removably couple the gobo holders 22 to the baseplate 21. Specifically, the gobo holders 22 are retained in place by the spring retainer 31, which engages a circular flange 26 in the gobo holder.

Figure 1B:
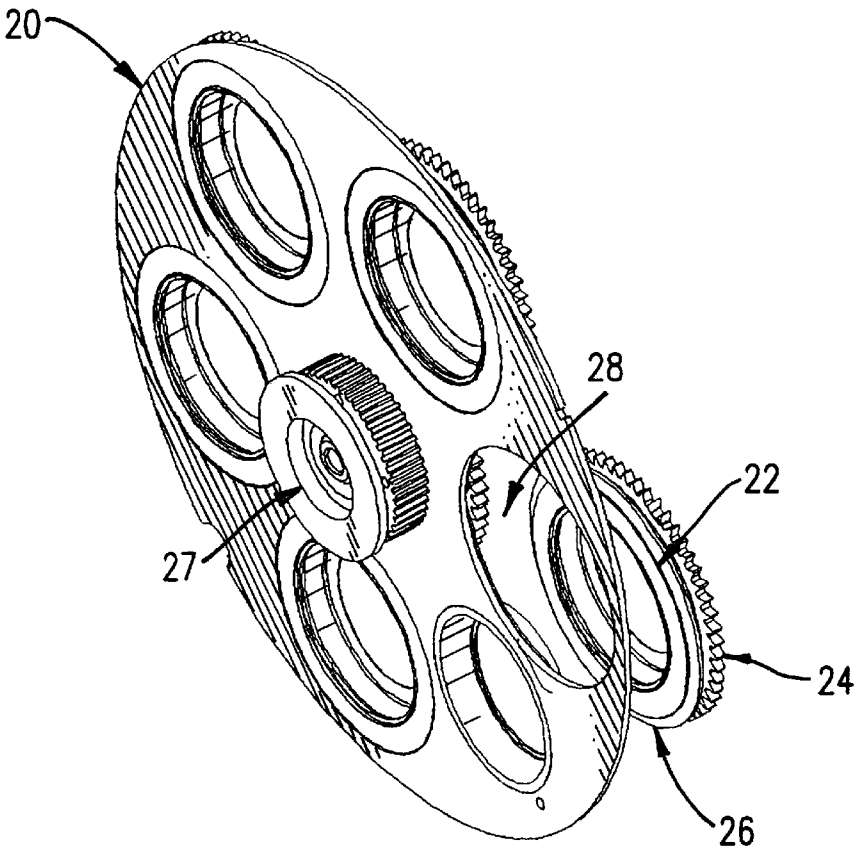
FIG. 1B is a back perspective view of the gobo wheel of FIG. 1A.

FIG. 1B is a perspective view of the back of the gobo wheel 20 of FIG. 1A. As may be appreciated, the gobo holder 22 is adapted to removably couple to the spring retainer, so as to align the gobo holder opening with the baseplate aperture 28. The baseplate 21 is fixedly coupled to a center rotation gear 27 that is adapted to facilitate the rotation of the gobo wheel by engaging with a motor gear to selectively provide an aperture 28 in the light path of the projector.

Figure 2B:
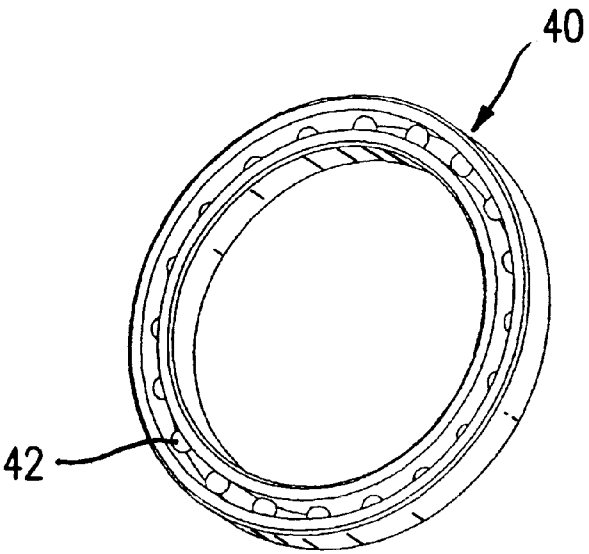
FIG. 2B illustrates a bearing of a gobo holder in accordance with the invention.
Figure 2A:
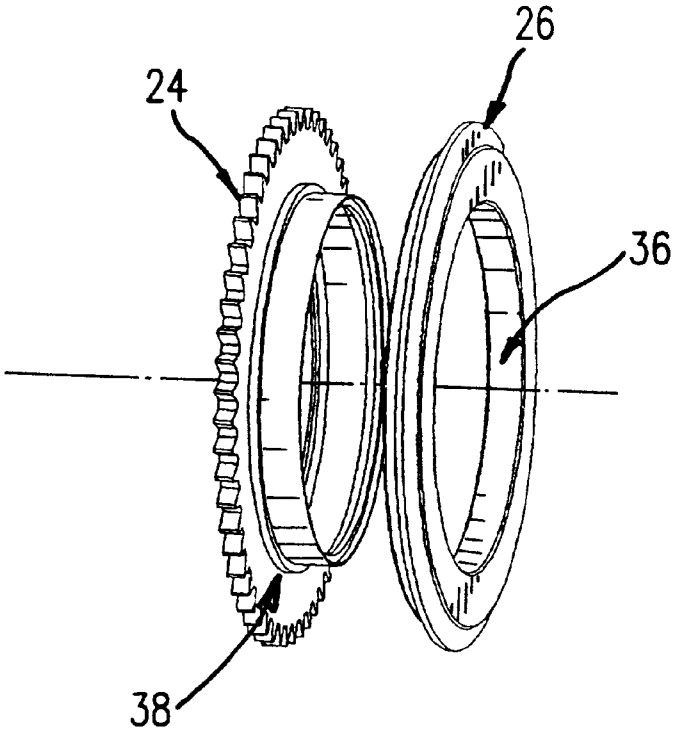
FIG. 2A illustrates a gobo retainer and a bearing housing of a gobo holder in accordance with the invention.

The gobo holder 22 is formed from two main parts, a toothed gear gobo retainer 38 and a bearing assembly 36. FIGS. 2A and 2B illustrate components of the gobo retainer and bearing assembly. A bearing ring 40 is formed from a pair of concentric rings, each including inward facing circumferential flanges, and a plurality of ball bearings 42, which are interposed between the flanges of the concentric rings. As may be appreciated, the ball bearings 42 allow for each ring to rotate relevant to the other ring about the common center axis. The bearing ring 40 fits inside a bearing housing to provide a bearing assembly 36 whereby the inner cylindrical portion of the bearing assembly, as defined by the inner ring of the bearing ring, is rotatable with respect to the outer portion of the bearing assembly. The bearing assembly is fixed over the gobo retainer 38 by the inner cylindrical portion of the bearing assembly engaging the outer cylindrical portion of the gobo retainer. Accordingly, the gobo retainer 38 is rotatable with respect to the outer portion of the bearing assembly. The bearing assembly fits into an appropriately sized aperture 28 in the baseplate 21 and provides the mounting point for the circular flange 26 on the outer portion of the bearing assembly by which the gobo holder 22 couples to the baseplate.

Figure 3:
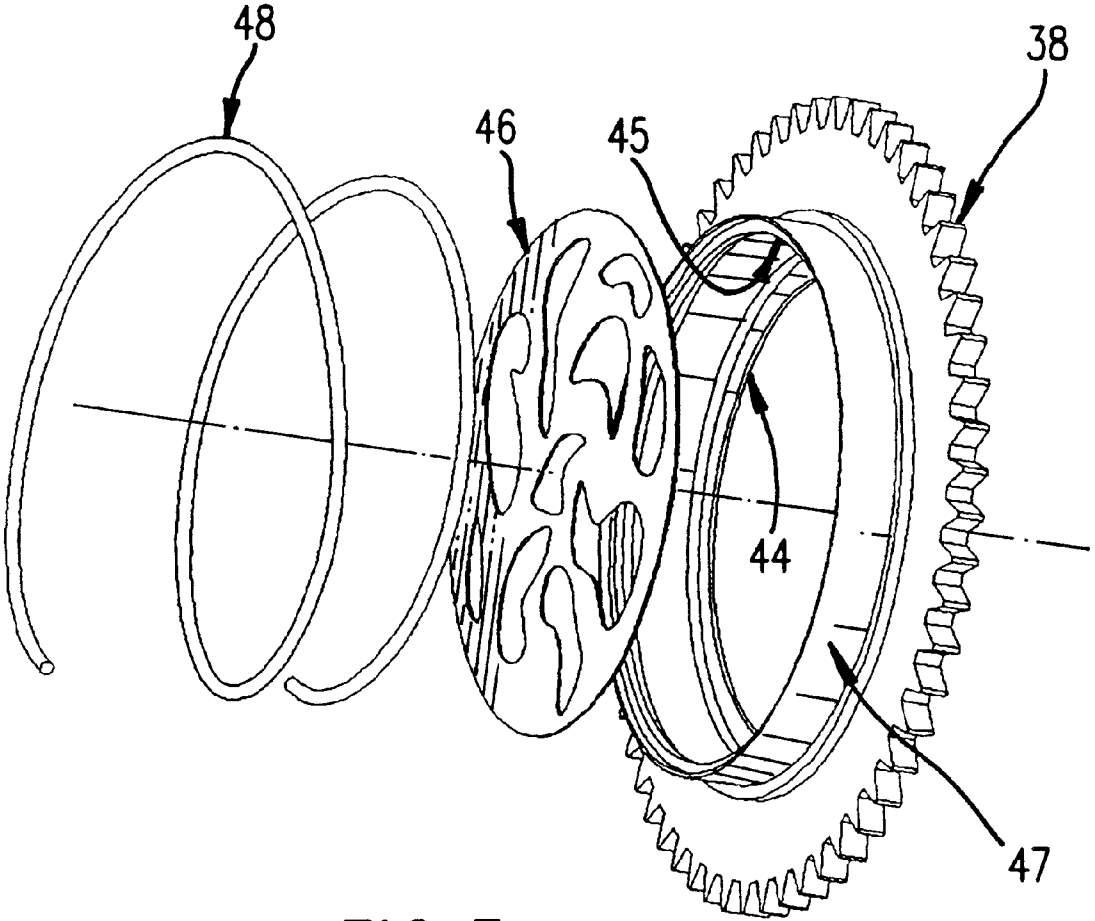
FIG. 3 illustrates a gobo retainer as well as a gobo and corresponding spring.

FIG. 3 illustrates a gobo retainer 38 as well as associated gobo and spring. The gobo retainer 38 includes a cylindrical portion 47 having a first end and a second end. An annular land 44 defines an aperture in the first end. An overhang 45 is provided in the inner circumference of the cylindrical portion near the second end. The spring 48 is preferably a conical spring tapering to a minimum inner diameter that is generally greater than the diameter of the gobo retainer aperture. Accordingly, the spring portion that extends from the gobo retainer 38 is relatively large, allowing convenient manipulation of the spring within the gobo retainer 38.

Figure 4B:
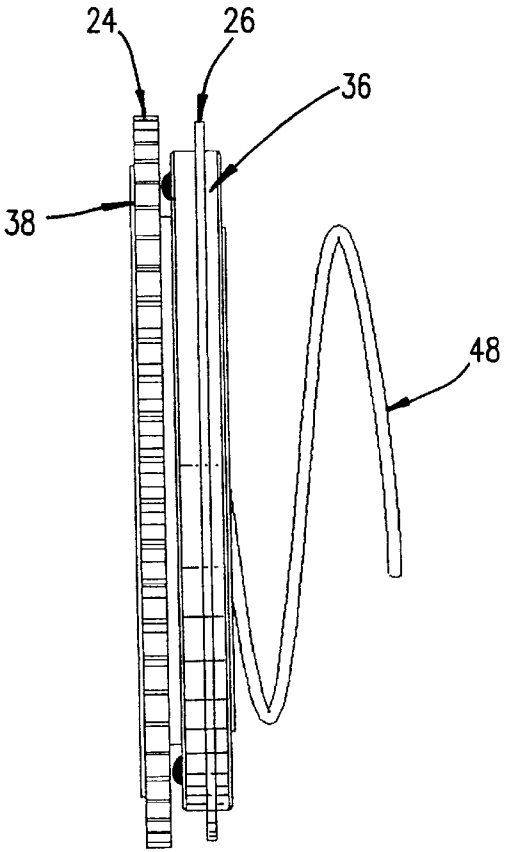
FIG. 4B is a second detail view of a gobo holder with a gobo secured therein.
Figure 4A:
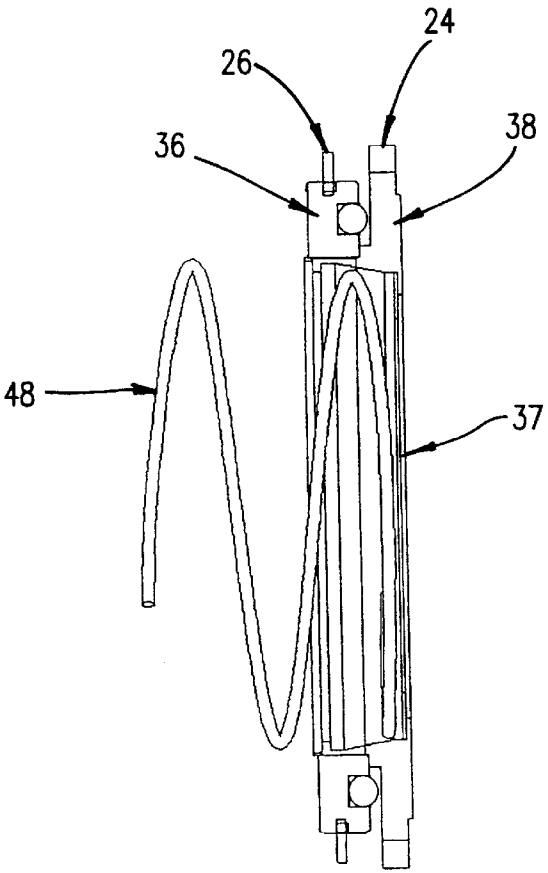
FIG. 4A is a first detail view of a gobo holder with a gobo secured therein.

FIG. 4A illustrates a detail view of a gobo holder of the invention when securing a gobo 37 therein. As may be appreciated, the flange 26 of the gobo holder extends generally perpendicular to the center axis of the gobo holder. The toothed portion 24 of the gobo holder extends generally parallel to the flange 26. The gobo retainer 38 is coupled to the inner cylindrical portion of the bearing assembly 36, as discussed above. When the gobo holder 22 is secured in the gobo wheel 20, the spring 48 is compressed within the gobo retainer 38 such that the spring does not extend outside the plane defined by the back opening of the gobo holder. Preferably, the gobo retainer 38 and the bearing assembly 36 are coupled together by placing the gobo retainer inside the bearing assembly and deforming the edge of the gobo retainer near its second end to couple to the inner cylindrical portion of the bearing assembly. In another embodiment, slide bearings are used in the bearing assembly to allow for the concentric rotation between the gobo retainer 38 and the bearing assembly 36.

FIG. 4B illustrates a second detail view of a gobo holder of the invention when securing a gobo. As shown, the toothed portion 24 of the gobo holder extends parallel to the flange 26 around the circumference of the gobo holder. The gobo holder preferably has a narrow profile, which facilitates convenient removal from, and replacement in, the gobo wheel.

Referring now to FIGS. 1, 2, 3, and 4, in operation, very little work space is required to remove the gobo holder 22 from the gobo wheel 20. Preferably, the entire gobo holder 22 is removed from the gobo wheel 20 when the corresponding gobo is to be replaced. The spring 48 in the gobo retainer 38 is removed to release the gobo. A new gobo is placed in the gobo retainer aperture against the land portion 44. The spring 48 is again compressed between peripheral portions of the gobo and the gobo retainer overhang 45.

When the gobo holder 22 is replaced into the baseplate, the toothed portion 24 re-engages the central sun gear 32, and the gobo wheel is driven in the conventional manner. As may be appreciated, since the entire gobo holder 22 is removed from the gobo wheel, the replacement of the gobo from within the gobo holder is much more convenient, and likely faster, than in prior systems.

Figure 5A:
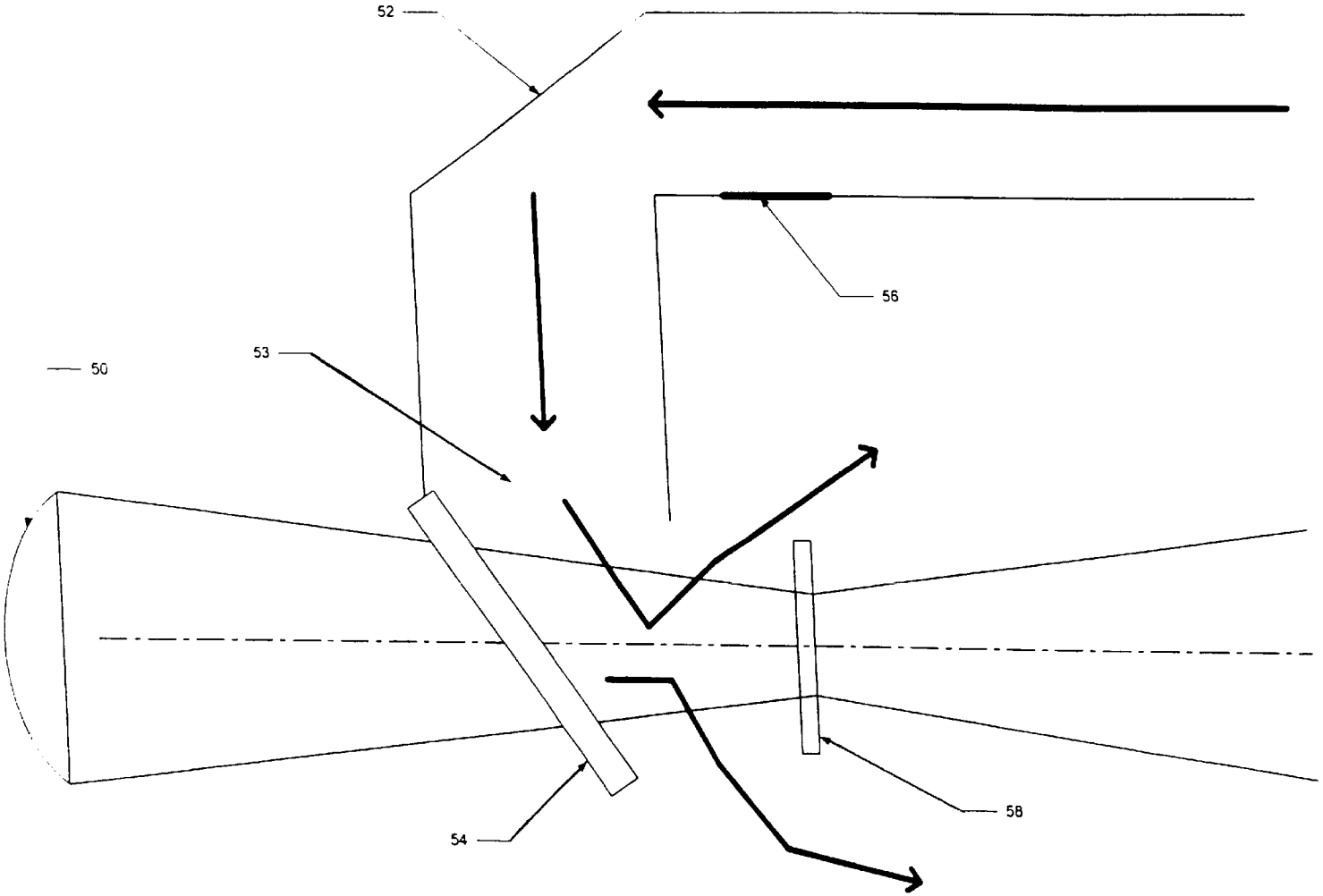
FIG. 5A illustrates a first embodiment of a gobo cooling system in accordance with the invention.
Figure 5B:
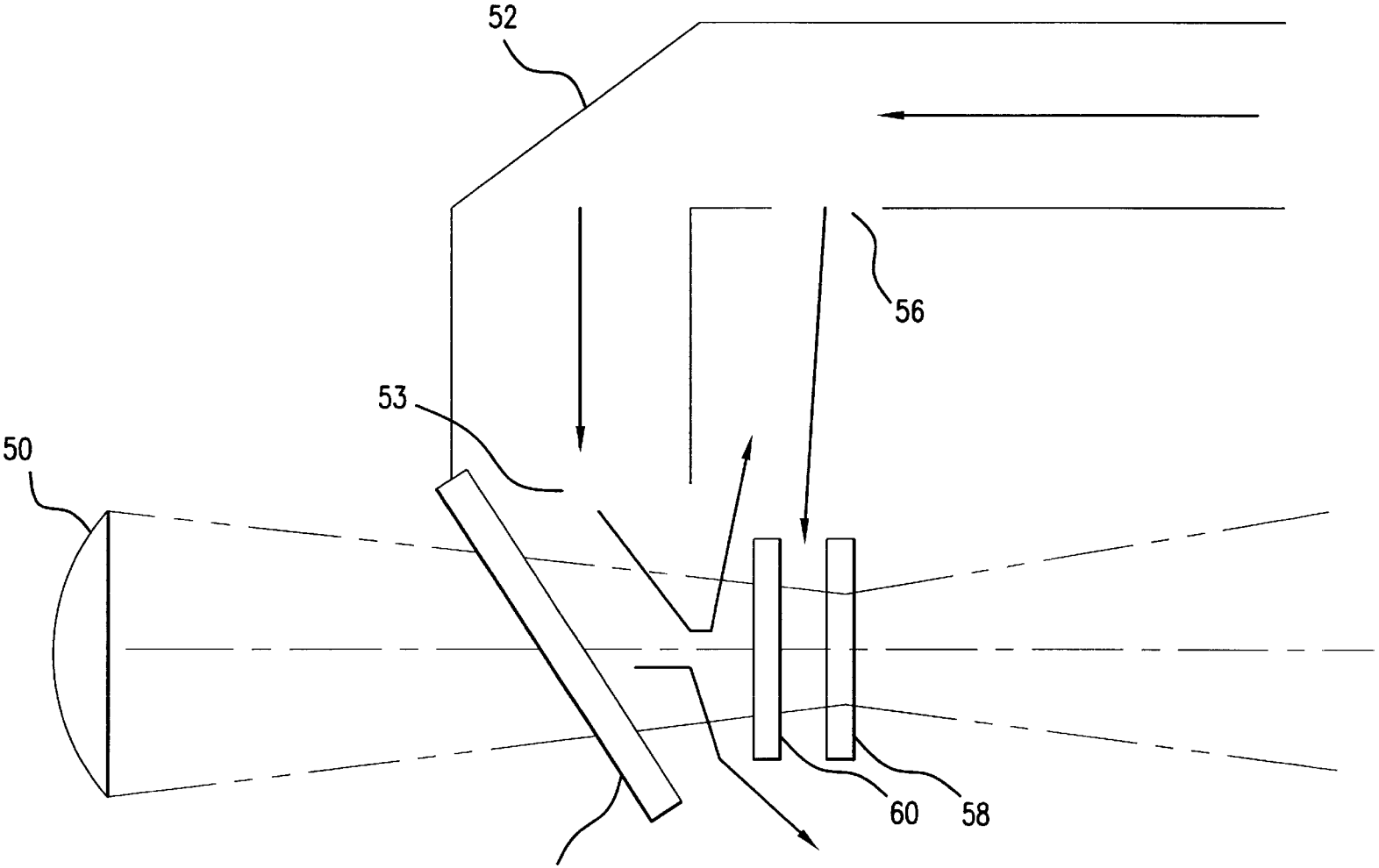
FIG. 5B illustrates a second embodiment of a gobo cooling system in accordance with the invention.

FIGS. 5A and 5B illustrate a gobo cooling system in accordance with the invention. A duct 52 channels air from an air forcing device (not shown), such as a fan, to an outflow opening 53 in the duct. The outflow opening 53 is directed to a transparent window 54, which is placed in the light beam at an angle to the optical axis of the projector. The window 54 reflects the air onto the gobo 58 to cool the gobo. In the embodiment of FIG. 5A, the ducting system is essentially closed. However, in other embodiments, as is illustrated in FIG. 5B, the ducting system includes an additional opening 56, offering cooling to other components in the system such as color filter wheels.

Figure 5C:
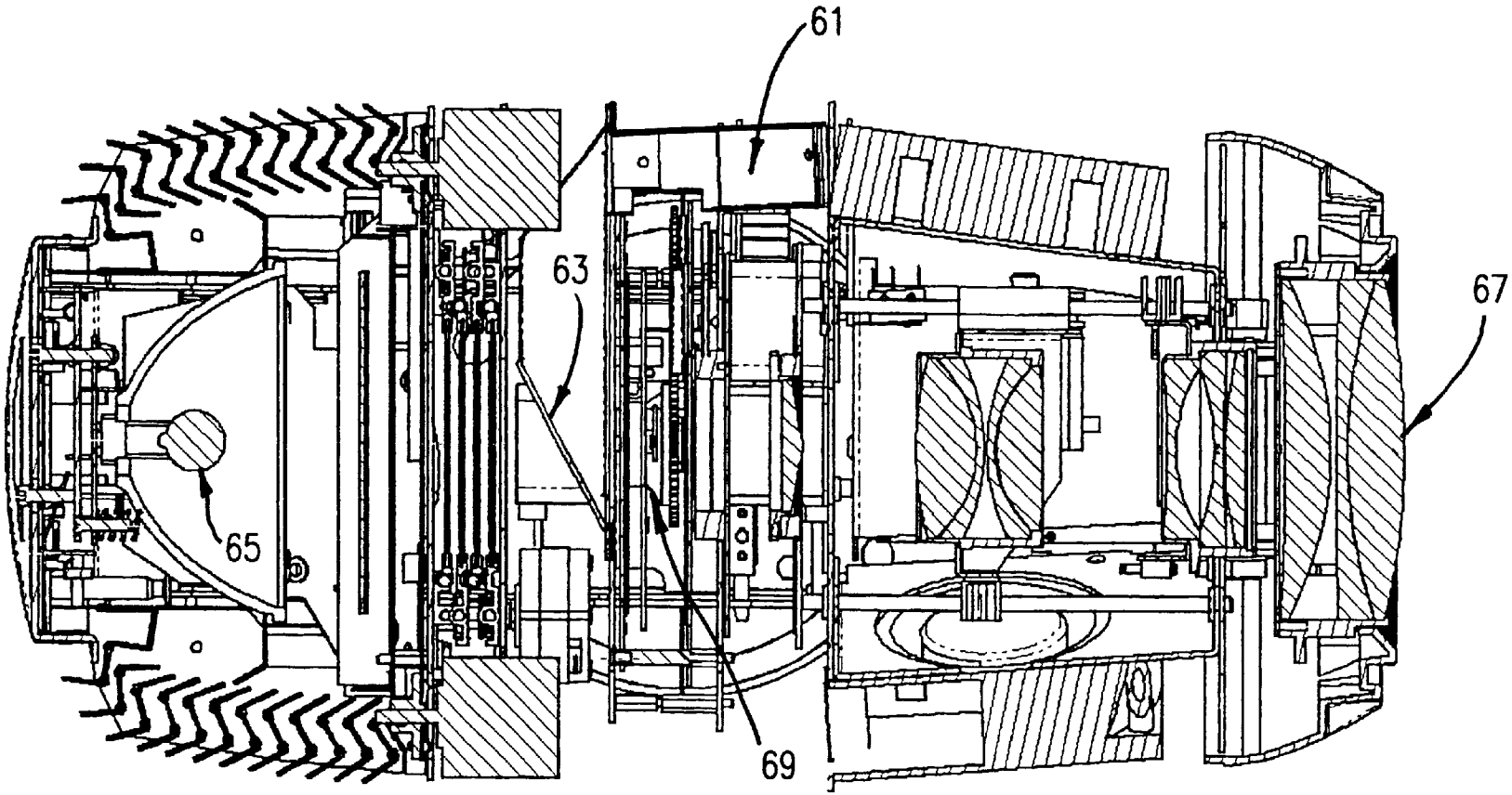
FIG. 5C illustrates a gobo cooling system of the invention in a projector assembly.

FIG. 5C illustrates the cooling system of FIG. 5A in a projector assembly. As discussed above, the projector includes a light source 65, a gobo wheel 69, and a light exit aperture 67. The Air outflow of duct 61 is directed to a transparent window 63, which is in the light path of the projector. The transparent window 63 directs the air onto the gobo wheel to cool a gobo 69, which is also in the light path.

Figure 6:
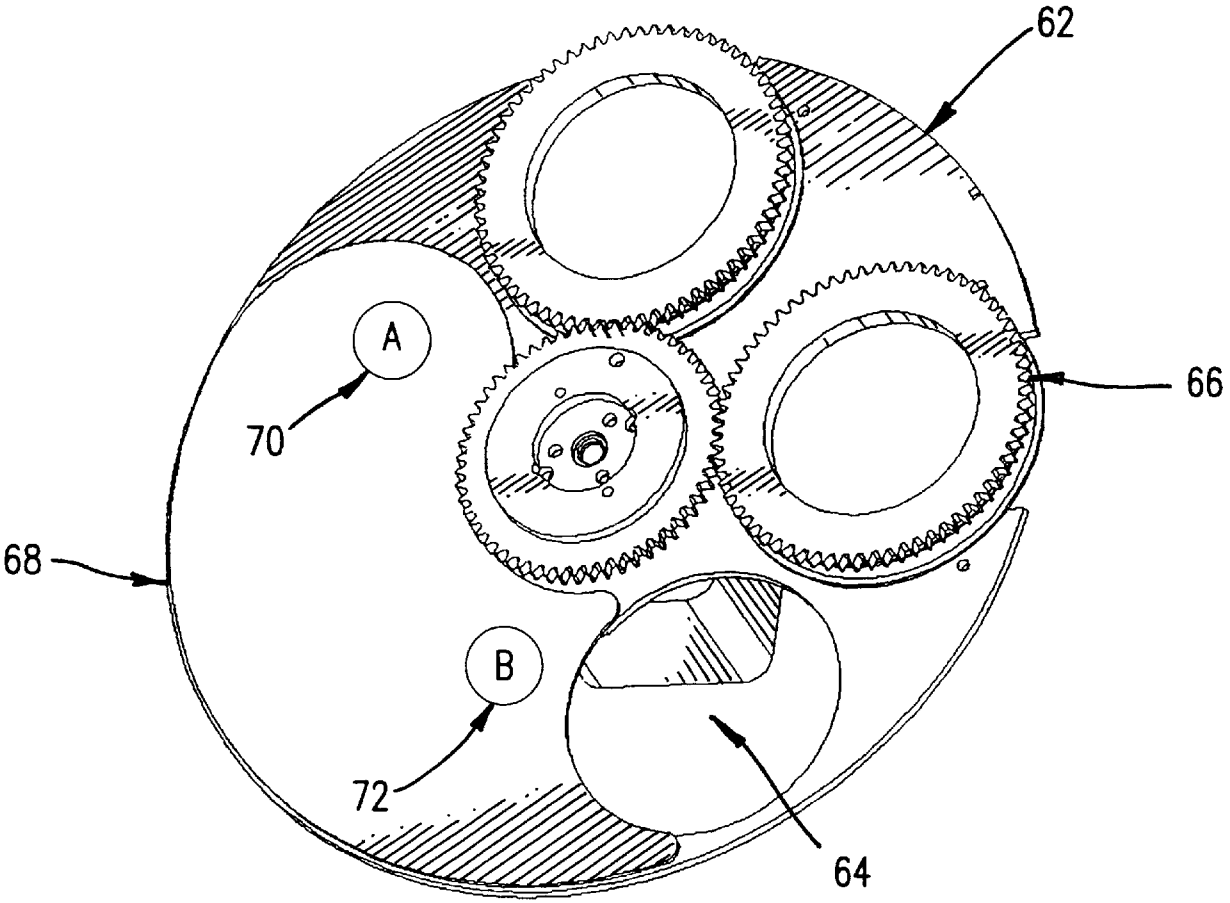
FIG. 6 illustrates an effect wheel with a frost effect in accordance with the invention.

FIG. 6 illustrates an effect module 62 of the projector. The effect module 62 includes a baseplate with replaceable rotating holders 66 of a near identical design to the above described gobo holders. However, the holders 66 preferably contain optical distortion effects. The carousel is mounted so as to intercept the optical axis in same manner as the rotating gobo wheel of FIG. 1. The wheel 62 is rotated to position the desired effect in the path of the light beam. The distortion effects may comprise such optical components as prisms, beam shapers, and other examples of lenticular lenses. Further to the effects, and forming another aspect of the present invention, is a variable frost filter 68.

A graduated frost filter 68 is illustrated in FIG. 6. The frost filter 68 is preferably provided along a portion of the periphery of the effects module 62. The frost filter 68 is mounted adjacent to a clear aperture 64, which allows for the passage of unadulterated light (0% frosting). The frost filter 68 is generally a transparent medium which has an unpolished surface. The degree to which this surface is roughened preferably determines the level of frosting for a projected beam. The frost filter 68 has light roughness around a first area 72(B) generally near the clear opening 64. The roughness of the filter increases as a function of angular displacement until reaching a heavy frost around a second area 70(A). Accordingly, when the frost filter 68 intercepts the light beam, the degree to which the image is frosted is varied by rotating the effects module 62.

Although the present invention was discussed in terms of certain preferred embodiments, the invention is not limited to such embodiments. Rather, the invention includes other embodiments including those apparent to a person of ordinary skill in the art. Thus, the scope of the invention should not be limited by the preceding description but should be ascertained by reference to the claims that follow.

What is claimed is:

1. A rotatable gobo wheel assembly comprising:

a rotatable baseplate including at least one aperture formed therein;

a gobo holder including a first flange around a circumference of the gobo holder and a toothed flange spaced from the first flange, the gobo holder forming an opening therein;

a spring retainer coupled to the baseplate, the spring retainer adapted to removably couple to the first flange of the gobo holder to position the open portion of the gobo holder in the aperture; and a center sun gear independently rotatable from the baseplate.

2. The gobo wheel assembly of claim 1, wherein the gobo holder is positioned to hold a gobo in a beam of light, the gobo holder comprising:

a retainer for removably retaining a gobo there within, said retainer having first and second ends and being positioned in said beam of light such that light enters said retainer through said first end, passes through said gobo and exits said retainer through said second end, the retainer including a toothed portion along its outer circumference;

a bearing assembly coupled to said retainer, the bearing assembly further including a flange portion along its outer circumference adapted to couple to a spring retainer in a gobo wheel assembly, the bearing assembly allowing the retainer to rotate about a common axis relative to the flange portion in the bearing assembly outer circumference;

said retainer and bearing assembly including a cup-shaped member having an inner circumferential wall defining a cylindrical space, the first end having an annular land defining an aperture in the member and the second open end including an overhang; and a resilient member removably mounted in the cylindrical space in a compressed position between the gobo and the overhang, whereby the gobo is removably retained adjacent the first end.

3. The gobo wheel assembly of claim 1, wherein the bearing assembly of the gobo holder includes a plurality of bearings to provide for the relative rotation between the retainer and the flange portion.

4. The gobo wheel assembly of claim 1, wherein the bearing assembly of the gobo holder includes a slide bearing to provide for the relative rotation between the retainer and the flange portion.

5. An optical element cooling system in a projector having a light source creating a light path within the projector, the projector including an optical element in the light path, comprising:

an air flow source coupled to an air ducting system in the projector, the ducting system directing air flow within the projector; and a window provided in the ducting system along the light path from the light source, the window positioned at an angle to the air flow to deflect air in the direction of the optical element while substantially allowing all light to pass through the window.

6. The optical element cooling system of claim 5, wherein the air ducting system includes an opening to provide a second air flow directed between a pair of optical elements.

7. The optical element cooling system of claim 5, wherein the optical element is a gobo.

8. The optical element cooling system of claim 7, wherein the window is positioned between the light source and the gobo.

9. An effects wheel in a light projector, comprising:

a rotatable baseplate having at least one aperture therein; and a transparent frost filter having a roughened surface forming a portion of the baseplate angularly extending from the aperture, the frost filter providing an angularly increasing frost effect from the aperture towards an angularly distant portion of the baseplate.

10. The effects wheel of claim 6 wherein the frost filter portion of the baseplate is a transparent element having a roughened surface, the surface roughness being at a minimum near the aperture and at a maximum near an angularly opposed end of the element.

11. A gobo carousel in a light projector having a light source and an exit aperture, the gobo carousel positioned between the light source and the exit aperture to place one of a plurality of gobos in the light path, the gobo carousel comprising:

a baseplate having a plurality of apertures spread radially along the baseplate surface, the apertures each defining an aperture circumference;

at least one spring retainer fixedly coupled to the baseplate, the spring retainer extending partially along the circumference of at least one of the apertures, the spring retainer provided substantially parallel to the baseplate in a spread apart configuration, the spring retainer adapted to removably hold a flange of a gobo holder; and at least one gobo holder, the gobo holder including a flange along its outer circumference.

12. The gobo carousel of claim 11, wherein the at least one spring retainer is a conical spring.

13. The gobo carousel of claim 12, wherein the spring tapers to a minimum diameter that is greater than the diameter of the gobo holder.

14. A gobo wheel assembly in a light projector, comprising:

rotatable base means for rotatably placing one of a plurality of apertures in a light path of a projector;

gobo holder means for holding a gobo in which light entering the gobo holder means is passed through the gobo and exits the gobo holder means, the gobo holder means including flange means; and spring retainer means for removably coupling said flange means on said gobo holder means, said gobo holder means being removably coupled to said rotatable base means.

* * * * *